US005463801A

United States Patent [19]

Kajiwara et al.

[11] Patent Number: 5,463,801

[45] Date of Patent: Nov. 7, 1995

[54] ROLLING MILL COATING EQUIPMENT

[75] Inventors: Toshiyuki Kajiwara, Tokyo; Teruo Yamagushi, Hitachi; Hitoshi Okoshi, Hitachi; Tsuneo Nakamura, Hitachi, all of Japan

[73] Assignee: Hitachi, Ltd., Tokyo, Japan

[21] Appl. No.: 200,668

[22] Filed: Feb. 23, 1994

[30] Foreign Application Priority Data

Feb. 26, 1993 [JP] Japan ..... 5-038135

[51] Int. Cl.[6] ..... B23P 23/04; B05C 3/00; B21B 15/00

[52] U.S. Cl. ..... 26/33 Q; 72/47; 118/419; 266/115

[58] Field of Search ..... 29/33 B, 33 Q, 29/33 C, 33 S; 118/67, 419, 33; 72/47, 365.2; 266/115, 107

[56] References Cited

U.S. PATENT DOCUMENTS

| | | | |
|---|---|---|---|
| 4,885,042 | 12/1989 | Kenmochi et al. | 72/365.2 |
| 5,009,396 | 4/1991 | den Hartog | 266/115 |
| 5,174,822 | 12/1992 | Nabhan et al. | 72/47 X |
| 5,197,179 | 3/1993 | Sendzimir et al. | 29/33 Q |

FOREIGN PATENT DOCUMENTS

| | | | |
|---|---|---|---|
| 702699 | 1/1965 | Canada | 72/47 |
| 2837847 | 3/1979 | Germany | 72/47 |
| 56-122611 | 9/1981 | Japan . | |
| 57-64403 | 4/1982 | Japan . | |
| 590034 | 1/1978 | U.S.S.R. | 72/47 |
| 2018270 | 10/1992 | WIPO | 29/33 Q |

OTHER PUBLICATIONS

Seitetsu Kikai Setsubi Soran (Handbook of Iron Manufacturing Machine and Equipment; published on Mar. 25, 1980).

*Primary Examiner*—William Briggs
*Attorney, Agent, or Firm*—Evenson McKeown Edwards & Lenahan

[57] ABSTRACT

A coating system and method of using same for coating a hot rolling strip coil, such as zinc coating of steel strip, is disclosed. The coating system includes sequentially arranged coil uncoilers, a strip welder, a pickling tank, a heating and deoxidizing furnace, a coating pot, and a coiler. A rolling mill with at least one cold rolling mill stand is interposed between the pickling tank and the heating and deoxidizing furnace. In certain operations with hot rolling strip coil having a larger than desired thickness, the cold rolling mill is operated to reduce the strip material thickness. In operations where the strip material is of proper desired thickness, the strip material is passed through the cold rolling mill without carrying out cold rolling. The system and method accommodate a single coating line usable with a wide variety of hot rolled strip material and finish coated material thicknesses.

16 Claims, 2 Drawing Sheets

ROLLING MILL COATING EQUIPMENT

BACKGROUND OF THE INVENTION

This invention relates to a coating equipment and a method of operating the coating equipment. More particularly, the present invention relates to a coating equipment for producing a zinc-coated steel strip using a hot rolling strip coil as the material and a method of operating the coating equipment.

As described, for example, in "SEITETSU KIKAI SETSUBI SORAN" (Handbook of Iron Manufacturing Machine and Equipment; published on Mar. 25, 1980), in a coating equipment for producing a coated strip with a material of hot-rolling strip coil (which will be sometimes referred to as a "hot coil"), the hot coil is passed sequentially through a coil uncoiler, a strip welder, a pickling line and a heating and deoxidizing furnace, then coated in a coating pot, and thereafter passed through a skin pass mill, etc, to provide a product. The product manufactured by such an equipment is called a "coating strip of hot rolling".

On the other hand, as described, for example, in Japanese Patent Laid-Open No. 122611/1981, a coating strip of cold rolling is produced by an equipment wherein a hot coil is first passed through a pickling line, then through a tandem type cold rolling mill having a differential speed rolling mill at its preceding stage, and thereafter through a coating line for coating strip of cold rolling. In this equipment, the pickling line, the rolling mill, the coating line, etc, are generally constituted as mutually independent equipments, and each of them is equipped with an uncoiler and a coiler for sequentially passing the hot coil through each of these independent lines. According to the technology described in above Japanese Patent Laid-Open No. 122611/1981, a treatment process as independent equipments and its continuing treatment process are selected by providing an uncoiler and a coiler to each of the pickling line, rolling mill and coating line so as to combine them as independent equipments, combining them and controlling the matching between them by a process computer.

Further, Japanese Patent Laid-Open No. 64403/1982 describes equipment in which a hot coil is passed through a descaling apparatus, is rolled by a plurality of passes through a reverse cold rolling mill and is thereafter passed through a cold-rolled material coating line. This equipment is provided with strip storage devices on the entry and exit sides of the reverse cold rolling mill, respectively.

Among the equipments described above, integrated steel makers producing steel products from hot coils mostly use a tandem type cold rolling mill in the rolling line, whereas merely-rolling manufactures who do not produce hot coils by themselves but purchase them from other manufacturers mostly employ a reverse cold rolling mill.

However, the prior art technologies described above are not free from the following problems.

Using the conventional coating equipment for producing hot rolling coating strips, coating strips can be produced at a by far lower cost than that of the coating strip of cold rolling. However, there is a limit of reduction of strip thickness because it is difficult to reduce the finish thickness in hot rolling. In other words, an ordinary hot strip mill is generally a tandem rolling mill having 5 to 7 stands. The minimum practical thickness is 1.2 mm. However, when 1.2 mm-thick strip is produced by a finishing mill having 6 to 7 stands, the surface of the work rolls turns rough due to high pressure, and bending and breakage of the strip occurs during threading and at tailing-off, resulting in extremely low productivity. Although demand for strips of smaller thickness of 1.0 to 0.8 mm exists on the market, this demand has not yet been satisfied.

In the equipment of producing coating strips of cold rolling, the thickness of the product can further be reduced. However, since strip coils must be passed sequentially through independent lines such as a pickling line, rolling line, coating line, and so forth, in each of these lines an uncoiler, a coiler, a welder for joining strips, etc, need to be installed redundantly. Accordingly, the overall installation cost becomes high and the transfer cost of coils between these lines further is added. As a result, the production cost rises. This can be also applied to the prior art technology described in Japanese Patent Laid-Open No. 122611/1981.

As described in "Prior Art" of Japanese Patent Laid-Open No. 64403/1982, the use of a reverse cold mill involves the problems of high costs of installing equipments including strip storing equipments arranged on both entry and exit sides of a reverse cold rolling mill, and of transferring coils between equipments, and further involves the problem that the reverse cold mill cannot inherently roll the leading and trailing edges of a coil. These problems lead to a low yield.

Furthermore, by the prior art technologies described above, it has been difficult to promptly produce a wide variety of coated strips required by users. For example, manufacturers having only a coating line for coating cold-rolled strip cannot purchase timely a variety of coils in small lots. Plating workers are also suffered from this problem. Even in the case of integrated steel makes, the same problem remains unsolved unless close production plans of hot strip mill is made with the sacrifice of the operation factor.

SUMMARY OF THE INVENTION

As described above, it has been difficult to promptly produce a variety of coating strips by the conventional equipments.

It is therefore an object of the present invention to provide a coating equipment and an operation method of the coating equipment which can promptly produce a variety of coating strips required by users at a low cost approximate to that of coating strips of hot rolling without rolling thin strips the rolling of which has been difficult by a hot strip mill.

To accomplish the object described above, according to the present invention a hot-rolling coil uncoiler, a strip welder, a pickling equipment, a heating and deoxidizing furnace, a coating pot and a coiler are sequentially disposed in this order, to coat the surface of a hot rolling strip coil wherein at least one stand of cold rolling mill is interposed between the pickling tank and the heating and deoxidizing furnace so that the hot rolling strip coil can be rolled in one pass.

In the coating equipment described above, the cold rolling mill can selectively effect cold rolling or empty pass of the hot-rolled strip coil.

In the coating equipment described above, at least one stand of cold rolling mill comprises a plurality of cold rolling mills arranged in a plural-stand stand tandem arrangement, and a hot-rolling strip coil is rolled by selectively using some of the cold rolling mills of a plurality of stands.

To accomplish the object described above, according to the present invention, an operation method of a coating equipment which includes a hot rolling coil uncoiler, a strip welder, a pickling equipment, a heating and deoxidizing furnace, a coating pot and a coiler, sequentially disposed in this order to coat the surface of a hot rolling strip coil, comprises selectively one of the following first and second steps: The first step of disposing at least one stand of cold rolling mill between the pickling equipment and the heating and deoxidizing furnace, opening the cold rolling mill so as to effect empty pass in accordance with the kind of the coating product, and coating the strip in the coating equipment; and The second step of effecting coating treatment in the coating equipment after cold rolling is carried out by the cold rolling mill.

In other words, the first step is selected to coat a strip having a large thickness, and the second step is selected to coat a strip having a small thickness.

According to the present invention described above, the hot-rolled strip coil can be rolled by a cold rolling mill in one pass and consequently, the coated strip can promptly be produced.

Since the cold rolling mill can selectively effect cold rolling or empty pass for the hot-rolled strip coil, a variety of coating strips required by users can be promptly produced.

First, when a coating product having a large thickness is produced, the first step is selected. In other words, the cold rolling mill is kept open for empty pass, and coating treatment is directly carried out. In other words, the coating equipment of the present invention can be used in the same way as of the conventional hot rolling strip coil coating equipment.

When a coating strip having a small thickness is produced, the second step is selected, and after cold rolling is effected by the cold rolling mill, the coating is performed. It is possible to produce, for example, a 1.0 mm-thick coating strip from a 2 mm-thick hot coil and a one-stand cold rolling mill, and a 0.8 mm-thick coating strip from a 1.6 mm-thick hot coil. When a hot coil having a constant thickness of, e.g., 1.6 mm, which can be easily produced, is employed, the thickness of the product can be changed within the range of thickness of 1.28 to 0.8 mm by changing the draft within a range of 20 to 50%. In this way, a variety of kinds of products in small lots can be timely produced and shipped.

According to the present invention, all the devices and equipments other than the cold rolling mills can be those for hot rolling strip. Therefore, redundant installation of uncoilers, winding machines, strip welders, etc, is not necessary, and rise of the installation cost and the operation cost can be limited to a low level.

Another advantage of the present invention is the reduction of scale loss. In other words, oxidized scale generally adheres to the surface of the hot-rolling strip, and the thickness of the adhering scale is about 15 μm on one side and 30 μm in total, on both sides. Though the oxidized scale is descaled by pickling, the thickness of the scale is irrelevant to the strip thickness.

Assuming that a 1.0 mm-thick hot coil is descaled, the scale loss results in the drop of yield of 0.03/1.0=3%.

When a 1.0 mm-thick strip is produced from a 2.0 mm-thick hot coil according to the present invention, the scale loss is 0.03/2=1.5% and the production yield can be improved by 1.5%.

As described above, the present invention can promptly produce a wide variety of coating strips required by users at a cost approximate to that of a hot rolling coating strip without rolling a thin strip which has been difficult to roll by a hot strip mill.

Incidentally, in the case of coating strips of hot rolling, annealing is not necessary and consequently, the heating temperature in a heating furnace may be about 500° C. However, coating strips of cold rolling need annealing and the heating temperature must therefore be raised to about 700° C. However, most coating strips of hot rolling are as thick as up to 4 to 6 mm, and the furnace has a heating capacity for them. In contrast, although the heating temperature must be elevated in the case of the coating strip of cold rolling, the strip thickness after cold-rolled is generally as thin as about 1 mm. Accordingly, the operation can be carried out without particularly lowering the threading rate. When, for example, three cold rolling mills described above are disposed in a tandem arrangement, strip of thickness of 0.27 mm, which is said to be the minimum thickness of the coating strip of continuous cold rolling, can be produced from a 1.8 mm-thick hot coil by setting the draws of the stands to feasible values of 50%. 50% and 40%, respectively.

DETAILED DESCRIPTION OF THE PREFERRED EMBODIMENTS

Hereinafter, preferred embodiments of the present invention will be described with reference to the accompanying drawings.

First of all, the first embodiment of the present invention, a coating strip of cold rolling, will be explained with reference to FIGS. 1 and 2.

Figure 1:
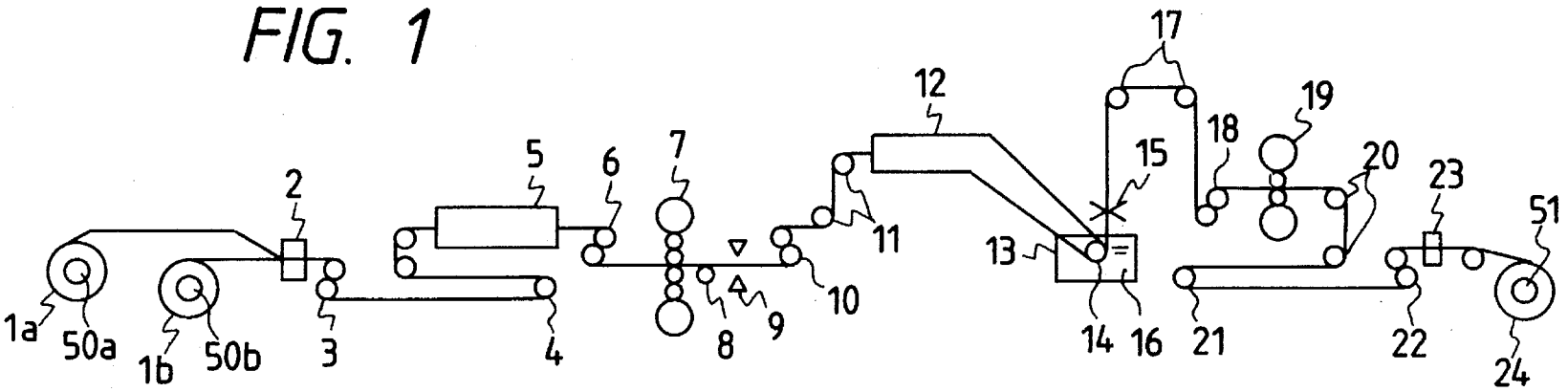
FIG. 1 is a schematic view of a coating equipment of the first embodiment according to the present invention.

Referring to FIG. 1, the coating equipment of this embodiment comprises uncoilers 50*a*, 50*b* of hot coils 1*a*, 1*b*, a welder 2 for joining strips, a bridle roll No.1 3, an entry looper 4, a pickling tank 5, a bridle roll No.2 6, a cold rolling mill 7, a tension meter 8, a thickness gauge 9, a bridle roll No.3 10, a furnace entry side deflector roll 11, a heating and deoxidizing furnace 12, a coating pot 13 having a sink roll 14 and a coating bath 16, a coating thickness controller 15, a deflector roller 17, a bridle roll No.4 18, a skin pass mill 19, a deflector roller 20, an exit looper 21, a bridle roll No.5 22, an exit shear 23 and a uncoiler 51 of a product coil 24, that are sequentially disposed in this order.

The cold rolling mill 7 is interposed between the pickling tank 5 and the heating and deoxidizing furnace 12. One cold rolling mill stand 7 is used in this embodiment, and effects rolling at a draft of 20 to 50% in the case of production of thin coated strips. The cold rolling mill 7 is kept open for empty pass in the case of the production of thick coated strips.

The cold rolling mill 7 desirably is small in size but can attain a high draft, and has the function of not deteriorating the shape of the strip even when the draft is changed. The most suitable rolling mill for this purpose is HC-MILL comprising a work roll to which a bending force is applied and a 6-high mill having an intermediate roll capable of shifting in the axial direction. Furthermore, UC-MILL equipped with means for imparting bending force to the intermediate roll, too, is most suitable. These rolling mills can easily attain a draft of 50% by one pass and have the function of stably maintaining the flat strip shape even when the draft, that is, the rolling force, is changed.

Figure 2:
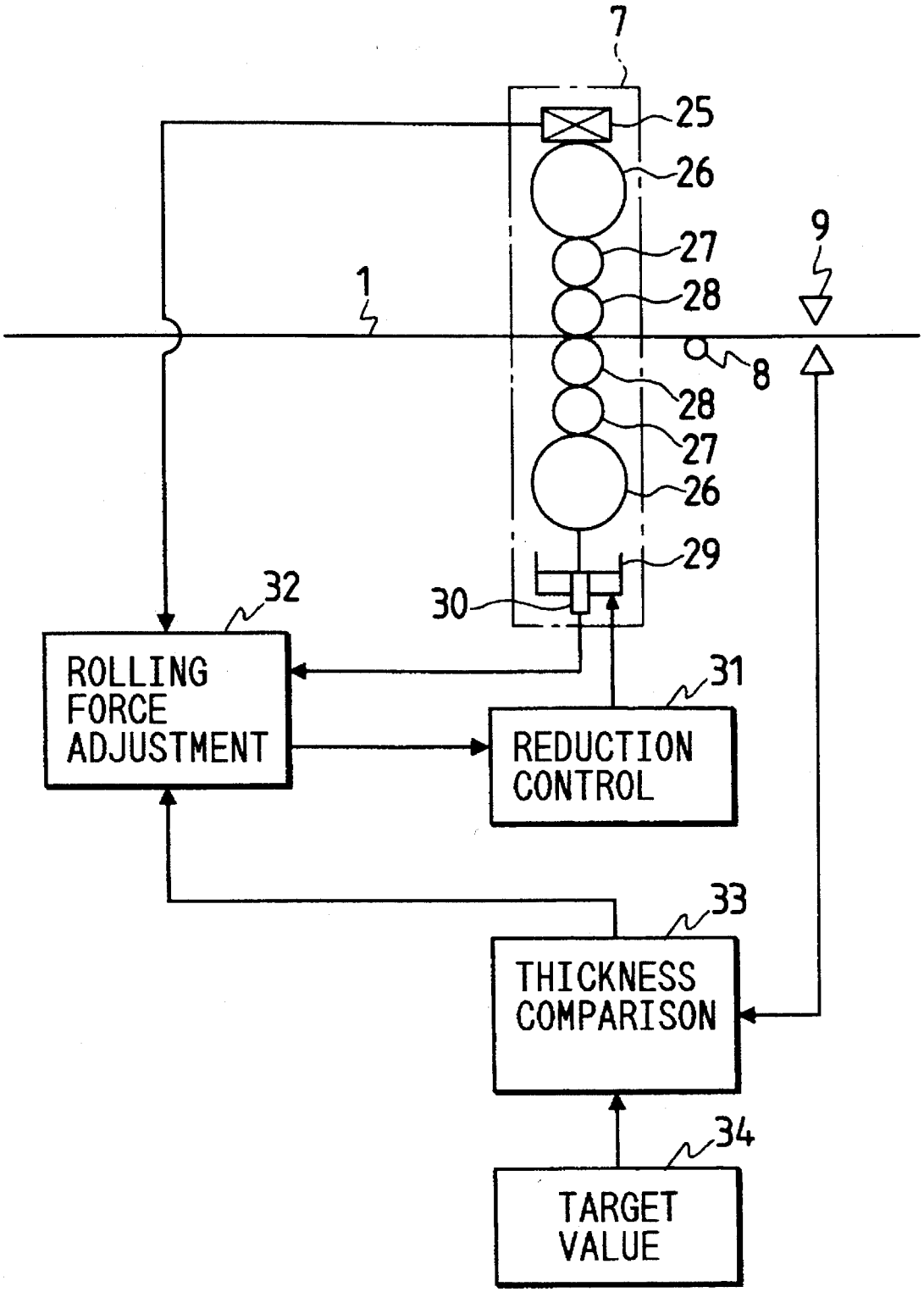
FIG. 2 shows a cold rolling mill shown in FIG. 1 and its control system.

FIG. 2 shows the cold rolling mill 7 and its control system. In this embodiment, the cold rolling mill 7 is for example, HC-MILL, which includes back-up rolls 26, 26, intermediate rolls 27, 27 and work rolls 28, 28. The intermediate rolls 27, 27 can shift in the axial direction, and the bending force can be imparted to the work rolls 28, 28.

In the cold rolling mill 7, the thickness of the rolling material 1 is subjected to feedback control in the same way as in the conventional thickness control method. In other words, the thickness gauge 9 is disposed on the downstream side of the cold rolling mill 7 so that the thickness of the rolling material 1 rolled between the work rolls 28, 28 of the cold rolling mill 7 can be measured by the thickness gauge 9. The thickness measurement value $h_a$ measured by the thickness gauge 9 is compared with a thickness control target value $h_{AGC}$ from a thickness control target setter 34 by a thickness comparator 33, and a signal representing this difference is sent to a rolling force control equipment 32. The thickness difference signal from the thickness comparator 33, a rolling force signal in the cold rolling mill 7 from a load cell 25 and a rolling position signal from a rolling position sensor 30 are inputted to the rolling force control equipment 32, which-outputs a rolling force signal to a hydraulic roll positioning device 31. When the thickness control target value is set to be greater than the thickness, the rolling force becomes zero, and the rolling mill can be kept open for empty pass.

Figure 3:
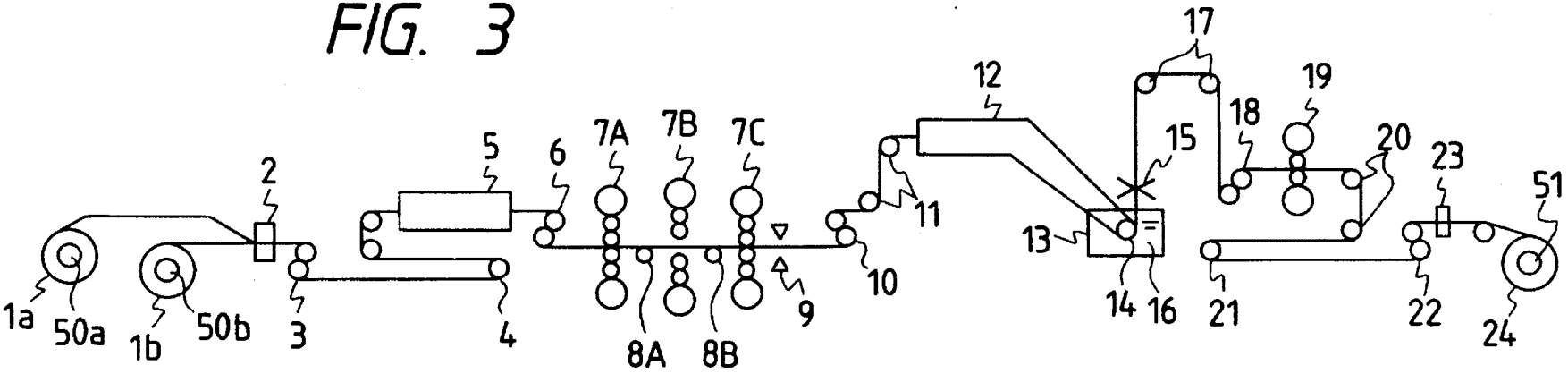
FIG. 3 is a schematic view of a coating equipment of the second embodiment according to the present invention.

FIG. 3 is a schematic view of the second embodiment, wherein the present invention is applied to the production of coating strip of cold rolling. This embodiment is directed to produce thinner coating strips, mainly coating strips of cold rolling.

The construction of the coating equipment shown in this drawing is the same as that of the coating equipment shown in FIG. 1. However, three, rolling mills or mill stands No.1 to No.3 7A, 7B and 7C are disposed as the cold rolling mills interposed between the pickling tank 5 and the heating and deoxidizing furnace 12, and this rolling equipment can produce hot coils having a thickness of about 1.8 mm to coating strips having a minimum thickness of 0.27 mm. Tension meters 8A and 8B are disposed between the rolling mill stands 7A and 7B and between rolling mill stands 7B and 7C.

To exchange the work roll of the rolling mill stand No.2 7B in the embodiment shown in FIG. 3, the thickness is set to a value so that the strip can be rolled by only the rolling mill stand No.1 7A and the rolling mill stand No.3 7C, and the work roll is then exchanged while the roll gap of the rolling mill stand No.2 7B is kept open. After a new roll is mounted, rolling is carried out using the three rolling mill stands 7A, 7B and 7C. The speed of a rolling mill motor at the time of exchange is so controlled that the speed of the final stand is constant and the other stand speeds are controlled as to keep the sheet tension constant by the tension meters 8A, 8B between the stands and not to cause breakage of the strip.

The embodiments shown in FIGS. 1 to 3 can first provide an economical coating strip in place of a coating strip of hot rolling. The minimum thickness which can be produced on the commercial basis by an orindary hot strip mill is 1.2 mm, but problems frequently occur due to rough surface of the rolls under a high pressure, bending and breakage of the strip at the time of threading and trailing-off, etc. Accordingly, rolling must be done with utmost care and quite naturally, the production cost becomes very high. Though there is a demand for further reduction of the thickness, the operation becomes all the more difficult. Even when hot rolling of a thickness of 1.0 mm can be done, the productivity drops to ½ in comparison with rolling of 2.0 mm and the scale loss rises from 1.5% to 3%, so that the loss of coil becomes ¥900/ton.

On the other hand, energy required for cold-rolling a strip from 2.0 mm to 1.0 mm is 15 KWhr/ton and is about ¥300, and saving of ¥600/ton can be attained.

To ensure a minimum thickness of 0.27 mm as in ordinary production lines of a coating strip of cold rolling, three cold rolling mills must be provided using a 1.8 mm-thick hot rolled strip as its material. In this embodiment, however, the pickling tank 5, the cold rolling mill stands 7A, 7B, 7C (see FIG. 3) and the coating pot 13 are disposed in series, and redundant installation of feeders, winding machines and welders for joining the strips as in the ordinary independent pickling line, the cold rolling mill and the coating line can be avoided. Accordingly, the installation cost becomes lower, and since two coil-transfer-operations between the lines can be eliminated, saving of ¥5,000/ton, on average can be attained.

Furthermore, the number of operators necessary for the operations can be reduced. One-stand reverse cold mills are generally used for the line described above with the exception of integrated steelworks of major steel manufactures. As to this example, 21 operators in total, are necessary, that is, two for the pickling line, two for the rolling mils, three for the coating line, i.e., seven operators, on three shifts, (7×3=21). By adopting the through-process line of this embodiment, on the other hand, the number of operators can be reduced to 4×3=12, and line operators can be saved. In connection with the production yield, unrolled portions are left at the leading and trailing end portions of the coil in the reverse cold rolling mill, and the yield is generally 3%. In this embodiment, the unrolled portions can be made zero. Assuming the saving of this loss is ¥1,800 when the price is 60,000 yen/ton and production output is 200,000 tons/annum, an increase of ¥360,000,000/annum of revenue can be gained.

Further, the rolling speed of 180 m/min of the cold rolling mill stand 7 (or rolling mill stands 7A, 7B, 7C) is lower than those of ordinary reverse rolling mills (1,000 to 1,400 m/min) and the work roll diameter can be reduced to as small as 200 to 300 mm in comparison with the diameters of the ordinary rolls of 400 to 500 mm. Accordingly, the rolling force can be reduced and the roll can be small. Since the right and left winding machines and the feeder of the coil which are necessary for the reverse rolling mill are not necessary, even three sets of the rolling mill stands can roll strips at substantially the same installation cost of the high speed reverse rolling mill.

It is conceivable to dispose a looper so as not to stop the coating line at the time of the exchange of the roll. In the embodiment shown in FIG. 3, however, the gaps of two stands among the three are set to a value with which rolling can be done at the time of the exchange of the roll, and the roll exchange is carried out while the stand to be exchange is brought into the empty pass state. Accordingly, the looper for this purpose is not necessary.

As described above, according to the present invention, a variety of coating strips required by users can be promptly produced at costs approximate to those of hot rolled coating material without carrying out thin strip rolling which cannot be rolled easily by a hot strip mill.

What is claimed is:

1. A coating system for continuously coating hot rolled strip material comprising the following sequentially disposed system stations:

a hot rolling coil uncoiler station, a pickling tank station, a cold rolling mill station, including a cold rolling control system for effecting single pass rolling of the strip material with a predetermined thickness reduction during operation with strip material thicker than desired for coating and for effecting passage of the strip material through the cold rolling mill station without rolling during operation with strip material of a desired thickness for coating, a heating and deoxidizing furnace station, and a coating station.

2. A coating system according to claim 1, further comprising a skinpass mill station and a coiler station arranged in sequence downstream of the coating station.

3. A coating system according to claim 1, further comprising a strip welder station arranged between the hot rolling coil uncoiler station and the pickling station, said strip welder station including welding means for welding together separate strip material sections from the uncoiler station to thereby provide a continuous strip of strip material for processing in said other stations.

4. A coating system according to claim 2, further comprising a strip welder station arranged between the hot rolling coil uncoiler station and the pickling station, said strip welder station including welding means for welding together separate strip material sections from the uncoiler station to thereby provide a continuous strip of strip material for processing in said other stations.

5. A coating system according to claim 1, wherein said cold rolling mill station consists of a single cold rolling mill stand.

6. A coating system according to claim 5, wherein said single cold rolling mill stand is a six high rolling mill stand having work roll bending means and intermediate rolls shifting means.

7. A coating system according to claim 4, wherein said cold rolling mill station consists of a single cold rolling mill stand.

8. A coating system according to claim 7, wherein said single cold rolling mill stand is a six high rolling mill stand having work roll bending means and intermediate rolls shifting means.

9. A coating system for continuously coating hot rolled strip material comprising the following sequentially disposed system stations:

a hot rolling coil uncoiler station, a pickling tank station, a cold rolling mill station, including a plurality of cold rolling mill stands arranged in series and control means for controlling said rolling mill stands so that a selected one of said mill stands permits pass through of said strip material without rolling while at least one other of said rolling mill stands cold rolls said strip material in a single pass, a heating and deoxidizing furnace station, and a coating station.

10. A coating system according to claim 9, further comprising a skinpass mill station and a coiler station arranged in sequence downstream of the coating station.

11. A coating system according to claim 9, further comprising a strip welder station arranged between the hot rolling oil uncoiler station and the pickling station, said strip welder station including welding means for welding together separate strip material sections from the uncoiler station to thereby provide a continuous strip of strip material for processing in said other station.

12. A coating system according to claim 10, further comprising a strip welder station arranged between the hot rolling oil uncoiler station and the pickling station, said strip welder station including welding means for welding together separate strip material sections from the uncoiler station to thereby provide a continuous strip of strip material for processing in said other station.

13. A coating system according to claim 9, wherein at least one of said cold rolling mill stands is a six high rolling mill stand having work roll benders and intermediate roll shifting devices.

14. A coating system according to claim 9, wherein said cold rolling mill station includes three cold rolling mill stands being selectively operable with rolling at two stands to facilitate continuous operation while changing rolls at the third stand.

15. A coating system according to claim 14, wherein at least one of said cold rolling mill stands is a six high rolling mill stand having work roll benders and intermediate roll shifting devices.

16. A coating system according to claim 15, wherein all three cold rolling mill stands are six high rolling mill stands having work roll benders and intermediate roll shifting devices.

* * * * *